US011319750B2

(12) United States Patent
Del Rossi

(10) Patent No.: US 11,319,750 B2
(45) Date of Patent: May 3, 2022

(54) SELF-CONTAINED GATE

(71) Applicant: VLM CONTAINERS INC., Lachine (CA)

(72) Inventor: Camillo Del Rossi, Lasalle (CA)

(73) Assignee: VLM CONTAINERS INC.

( * ) Notice: Subject to any disclaimer, the term of this patent is extended or adjusted under 35 U.S.C. 154(b) by 83 days.

(21) Appl. No.: 16/539,077

(22) Filed: Aug. 13, 2019

(65) Prior Publication Data

US 2020/0056425 A1 Feb. 20, 2020

Related U.S. Application Data

(60) Provisional application No. 62/718,634, filed on Aug. 14, 2018.

(51) Int. Cl.

| | |
|---|---|
| ***E06B 11/02*** | (2006.01) |
| ***E04H 17/00*** | (2006.01) |
| ***E04H 1/12*** | (2006.01) |
| ***E06B 11/04*** | (2006.01) |

(52) U.S. Cl.

CPC ..... *E06B 11/026* (2013.01); *E04H 1/12* (2013.01); *E04H 17/00* (2013.01); *E06B 11/045* (2013.01); *E04H 2001/1283* (2013.01)

(58) Field of Classification Search

CPC ..... E06B 11/026; E06B 11/045; E06B 2009/002; E04H 1/12; E04H 2001/1283; E04H 17/00; B65D 88/121; E01F 13/048; E01F 13/08; E01F 13/02; E01F 13/04

See application file for complete search history.

(56) References Cited

U.S. PATENT DOCUMENTS 1,882,331 A * 10/1932 Martinek ..... E06B 9/0661 160/33
3,304,135 A * 2/1967 Hasselmark ..... E05D 15/063 384/418
4,723,374 A 2/1988 Peterson et al.
5,605,016 A * 2/1997 Pollard ..... E05D 15/0652 49/506

(Continued)

FOREIGN PATENT DOCUMENTS

EP 3144428 A1 * 3/2017 ..... E01F 13/08
WO 2011088558 A1 7/2011
WO WO-2017046322 A1 * 3/2017 ..... E01F 13/08

*Primary Examiner* — Brent W Herring

(74) *Attorney, Agent, or Firm* — Lavery, De Billy, LLP; Hugh Mansfield

(57) ABSTRACT

A modular self-contained gate for selectively blocking an entryway comprising an ISO standard shipping container modified such that an existing closed end wall of the shipping container comprises an elongate slot-like opening arranged vertically and adjacent an edge of the closed end wall, a substantially flat and rectangular gate comprising a long edge having a length substantially the same as a length of the shipping container and a height less than a height of the opening, the gate aligned with and linearly displaceable through the opening between a first position wherein the gate is stored inside the shipping container and the entryway is open and a second position wherein the gate is extended outside of the shipping container and passage via the entryway is barred, and a support mechanism inside the shipping container suspending the gate such that the gate remains suspended above the ground.

16 Claims, 9 Drawing Sheets

(56) References Cited

U.S. PATENT DOCUMENTS

| | | | | |
|---|---|---|---|---|
| 5,873,205 | A * | 2/1999 | Hanlon | E04B 2/7416 52/239 |
| 6,092,338 | A * | 7/2000 | Crowner | E05F 15/643 49/360 |
| 6,202,729 | B1 * | 3/2001 | Cunningham | E06B 9/0623 160/136 |
| 6,349,793 | B1 * | 2/2002 | Kincaid | B66F 11/04 182/141 |
| 7,802,521 | B2 * | 9/2010 | Gunes | B61B 1/02 104/30 |
| 8,950,158 | B2 | 2/2015 | Walton | |
| 9,212,521 | B2 | 12/2015 | McCarty et al. | |
| 9,217,273 | B2 * | 12/2015 | Floersch | E06B 3/805 |
| 9,452,761 | B2 * | 9/2016 | Romero | E05D 15/063 |
| 10,319,164 | B1 * | 6/2019 | Sprogis | G07C 9/27 |
| 10,501,260 | B2 * | 12/2019 | Brennan, Jr. | E04B 1/3483 |
| 10,570,577 | B2 * | 2/2020 | Kramer | E01F 13/048 |
| 2004/0129732 | A1 * | 7/2004 | Kutner | B65D 19/20 222/185.1 |
| 2009/0165665 | A1 * | 7/2009 | Gunes | B61B 1/02 104/30 |
| 2012/0297685 | A1 * | 11/2012 | Kawamoto | E06B 3/2605 49/372 |
| 2014/0259930 | A1 * | 9/2014 | Gilliam | E06B 11/026 49/70 |
| 2018/0010380 | A1 * | 1/2018 | Kapavik | E05D 15/0691 |
| 2018/0273288 | A1 * | 9/2018 | Brennan, Jr. | E04B 2/62 |

* cited by examiner

SELF-CONTAINED GATE

CROSS REFERENCE TO RELATED APPLICATIONS

This application claims benefit under 35 U.S.C. § 119(e) of U.S. provisional application Ser. No. 62/718,634 filed on Aug. 14, 2018 which is incorporated herein in its entirety by reference.

FIELD OF THE INVENTION

The present invention relates to a self-contained gate.

BACKGROUND OF THE INVENTION

Sliding or rolling gates are used to allow access to a closed-off entryway. Typically, these gates are installed adjacent to a wall or fence and slide or roll behind the wall or fence when retracted. Many of these gates comprise components that are exposed to the elements and to thieves who can easily cut the chains locking the gate to gain access to the entryway. Some gates are designed to retract into a housing so that they are hidden when not in use. However, these hidden gates are often quite complicated in their design and assembly, and do not offer sufficient protection for the gate and its associated components when stowed. In addition, these hidden gates are difficult or nearly impossible to move, restricting their use to one location.

It is therefore an object of the present invention to provide a retractable gate that is easily transportable, difficult to break into, and stows into a secure housing to protect the gate and its associated components from the elements.

SUMMARY OF THE INVENTION

In order to address the above and other drawbacks, there is provided a modular self-contained gate for selectively blocking an entryway comprising an ISO standard shipping container modified such that an existing closed end wall of the shipping container comprises an elongate slot-like opening arranged vertically and adjacent an edge of the closed end wall, a substantially flat and rectangular gate comprising a long edge having a length substantially the same as a length of the shipping container and a height less than a height of the opening, the gate aligned with and linearly displaceable through the opening between a first position wherein the gate is stored inside the shipping container and the entryway is open and a second position wherein the gate is extended outside of the shipping container and passage via the entryway is barred, and a support mechanism inside the shipping container suspending the gate such that the gate remains suspended above the ground.

In an embodiment, the support mechanism comprises a plurality of front support posts adjacent to the opening for supporting the gate, each front support post comprising a support bracket assembly supporting one of a plurality of roller bearing carriages, each roller bearing carriage comprising a plurality of roller bearings, and wherein the gate comprises a plurality of stabilizing channels, the stabilizing channels rollable along the plurality of roller bearings.

In an embodiment, the modular self-contained gate further comprises an actuator for moving the gate between the first position and the second position.

In an embodiment, the shipping container further comprises a lockable entrance.

In an embodiment, the lockable entrance comprises a door.

In an embodiment, the modular self-contained gate is transportable.

In an embodiment, the modular self-contained gate further comprises a control panel for controlling the actuator.

In an embodiment, the actuator comprises a motor and a chain, the chain connecting the motor to the gate via a motor output drive gear, and the modular self-contained gate further comprises a first sprocket connecting the chain to a far-end support post adjacent to a second closed end wall via a first pair of sealed roller bearings, a second sprocket connecting the chain to one of the front support posts via a second pair of sealed roller bearings, and a tab emanating from the gate attaching the chain to the gate via a plurality of tensioner bolts.

In an embodiment, each of the plurality of roller bearings is mounted with a Teflon guide.

In an embodiment, the modular self-contained gate further comprises a self-sustaining power generation and storage system to power the actuator.

In an embodiment, the gate is openable and closable by at least one of a keypad system, a radio-controlled remote, and a manual disconnect lever.

In an embodiment, the modular self-contained gate further comprises a surveillance system for monitoring the modular self-contained gate.

In an embodiment, the surveillance system comprises at least one of a security camera and an autonomous drone.

In an embodiment, the gate is supported at one end such that a suspended end of the gate resists dipping when in the second position.

In an embodiment, each support bracket assembly comprises a support bracket mounted to a respective the front support post and a threaded rod linking the roller bearing carriage to the support bracket, wherein the height of each roller bearing carriage is adjustable via a corresponding the threaded rod.

In an embodiment, the modular self-contained gate further comprises a plurality of far-end support posts and a second opening in a second end wall such that a second entryway is securable by the system.

In an embodiment, the modular self-contained gate further comprises a second gate exitable through the second opening in the second end wall such that the first entryway and the second entryway are individually and simultaneously securable by the system.

There is also provided a method of manufacturing a modular self-contained gate for selectively blocking an entryway comprising the steps of fashioning an elongate slot-like opening in an existing end wall of an ISO standard shipping container, the opening arranged vertically and adjacent an edge of the closed end wall, and installing a substantially flat and rectangular gate inside the fashioned shipping container, the gate comprising a long edge having a length substantially the same as a length of the shipping container and a height less than a height of the opening, the gate aligned with and linearly displaceable through the opening between a first position wherein the gate is stored inside the shipping container and the entryway is open and a second position wherein the gate is extended outside of the shipping container and passage via the entryway is barred, the gate suspended by a support mechanism inside the shipping container such that the gate remains suspended above the ground.

There is also provided a system for selectively allowing and blocking access to an area comprising a plurality of abutting ISO standard shipping containers, a modular self-enclosed gate comprising a modified ISO standard shipping container comprising an existing closed end wall comprising an elongate slot-like opening arranged vertically and adjacent an edge of the closed end wall, the modular self-enclosed gate further comprising a substantially flat and rectangular gate comprising a long edge having a length substantially the same as a length of the shipping container and a height less than a height of the opening, the gate aligned with and linearly displaceable through the opening between a first position wherein the gate is stored inside the shipping container and the entryway is open and a second position wherein the gate is extended outside of the shipping container, the gate supportable by a support mechanism inside the modified shipping container, the modular self-enclosed gate abutting with one of the plurality of ISO standard shipping containers together defining the area, and an entryway providing access to the area defined by a gap between the modular self-enclosed gate and one of the plurality of ISO standard shipping containers, the gate closing at least a portion of the entryway in the second position, the entryway having a length at most the same as the gate length.

DETAILED DESCRIPTION OF THE ILLUSTRATIVE EMBODIMENTS

Figure 1:
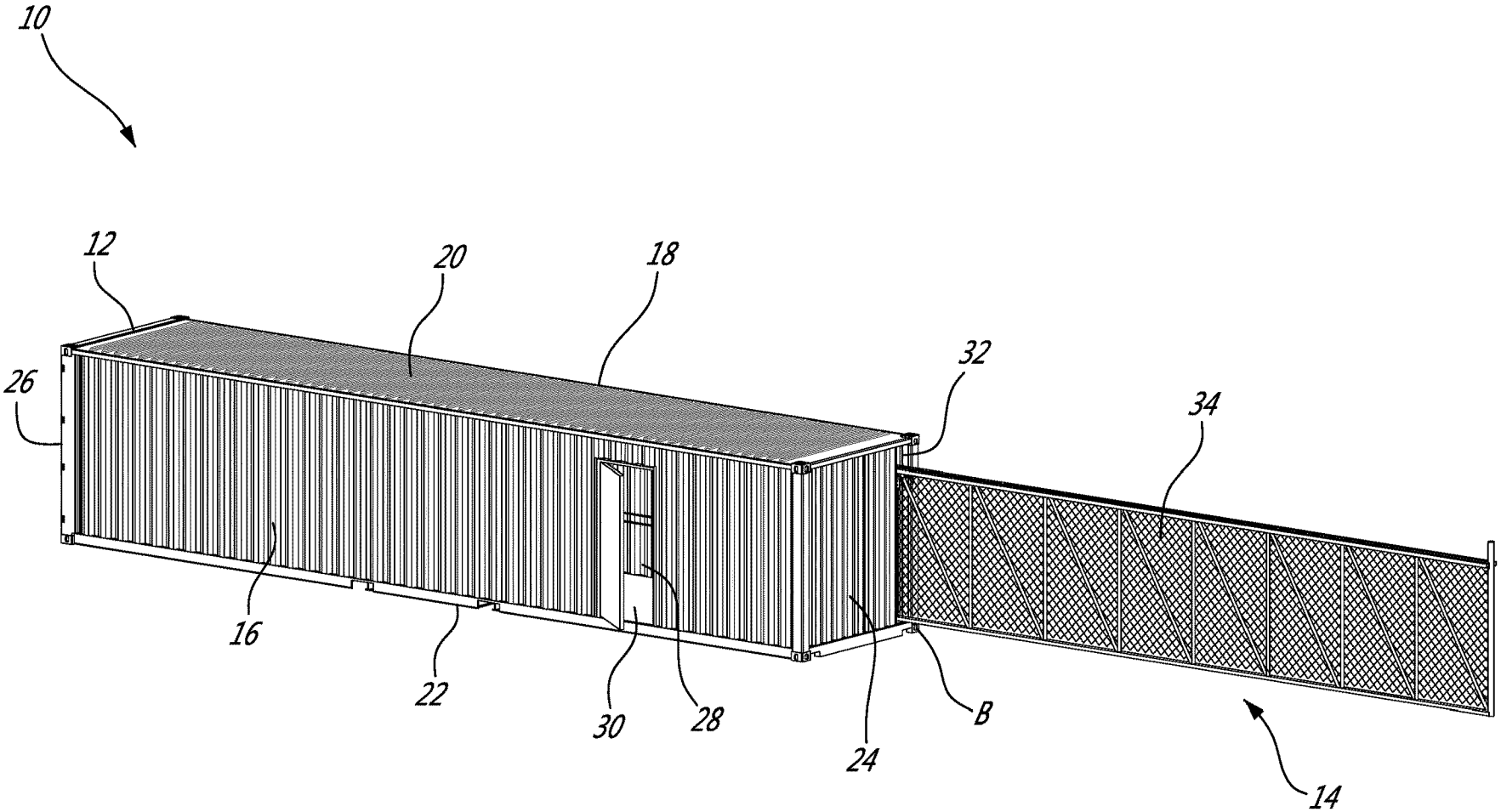
FIG. 1 provides a front raised perspective view of a modular self-contained gate in a closed position, in accordance with an illustrative embodiment of the present invention.

Referring to FIG. 1, a modular self-contained gate, generally referred to using the reference numeral 10, will now be described. The modular self-contained gate 10 comprises a shipping container 12 that is configured to secure an entryway 14. As a person of skill in the art would understand, ISO-standardized shipping containers are roughly 8 feet wide and are available in a variety of lengths (2, 4, L, M), heights (2, 5) and types (G1, R1, U1, P1, Y1) however non-standard sized shipping containers may also be used for the present invention. Further, a person of skill in the art would understand that as shipping containers are portable by their nature, the modular self-contained gate 10 is portable as well. As such, the modular self-contained gate 10 may be transported to various locations in order to secure various entryways 14. Shipping container 12 comprises a front wall 16, a rear wall 18, a top wall 20, a bottom wall 22, a first closed end wall 24 and a second end wall 26 defining a container space 28 therein. The front wall 16 comprises a lockable entrance 30, illustratively a door, providing access to the container space 28. In an embodiment, access to the container space 28 is provided by the shipping container's 12 standard doors (not shown) rather than by the above-mentioned entrance 30. The first closed end wall 24 comprises an elongate slot-like opening 32 arranged vertically and adjacent an edge of the first closed end wall 24. The opening 32 is sized to allow a substantially flat and rectangular gate 34 to linearly displace in and out of the container space 28 to secure and provide access to entryway 14. The gate 34 comprises a long edge having a length substantially the same as a length of the shipping container 12 and a height less than the height of the opening 32.

Figure 2:
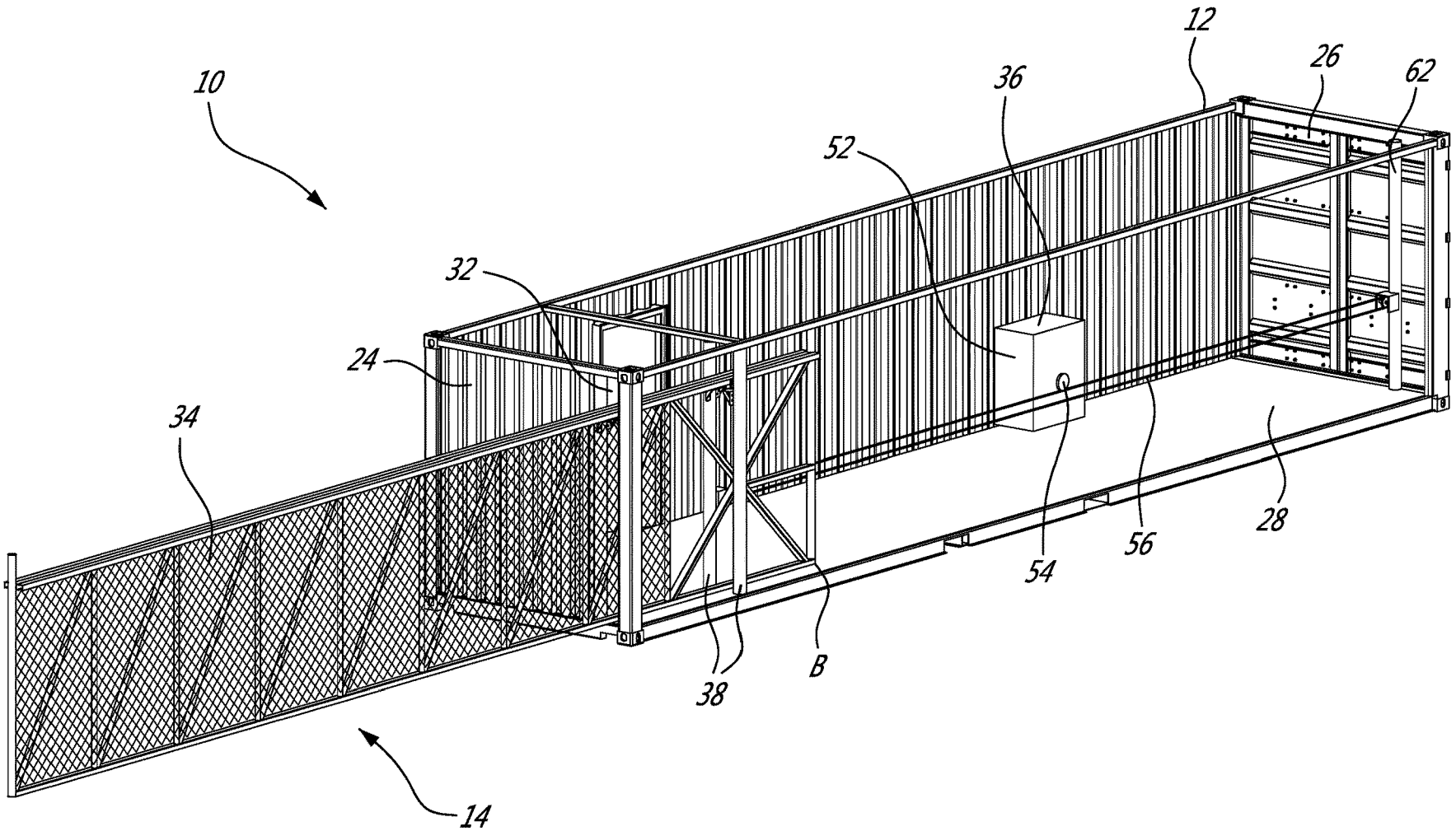
FIG. 2 provides a rear raised perspective view of a modular self-contained gate in a closed position with the rear wall and top wall hidden, in accordance with an illustrative embodiment of the present invention.

Still referring to FIG. 1, the gate 34 is aligned with the opening 32 and linearly displaceable between a first position A (as will be shown in FIG. 8) in which the entryway 14 is open and gate 34 is stored inside of the shipping container 12, and a second position B (as shown in FIGS. 1 and 2) in which the entryway 14 is closed and the gate 34 is extended outside of the shipping container 12. As such, in the second position B, passage via the entryway 14 is barred. In an embodiment, the gate 34 is supported at one end such that the suspended end remains suspended over the ground and resists any dipping when extended over the entryway 14. In an alternate embodiment, shipping container 12 further comprises an opening cover (not shown) to seal the opening 32 when the gate 34 is in the first position A. While an existing shipping container 12, comprising a standard or non-standard size, may be modified for the purposes of the present invention, for example by cutting out an entrance 30 and opening 32, in an alternate embodiment a shipping container-like enclosure may be built specifically for the purposes of the present invention comprising, for example, an entrance 30 and an opening 32. In an embodiment, gate 34 may comprise a steel structure with galvanized and aluminium components for improved strength and finish.

Figure 3:
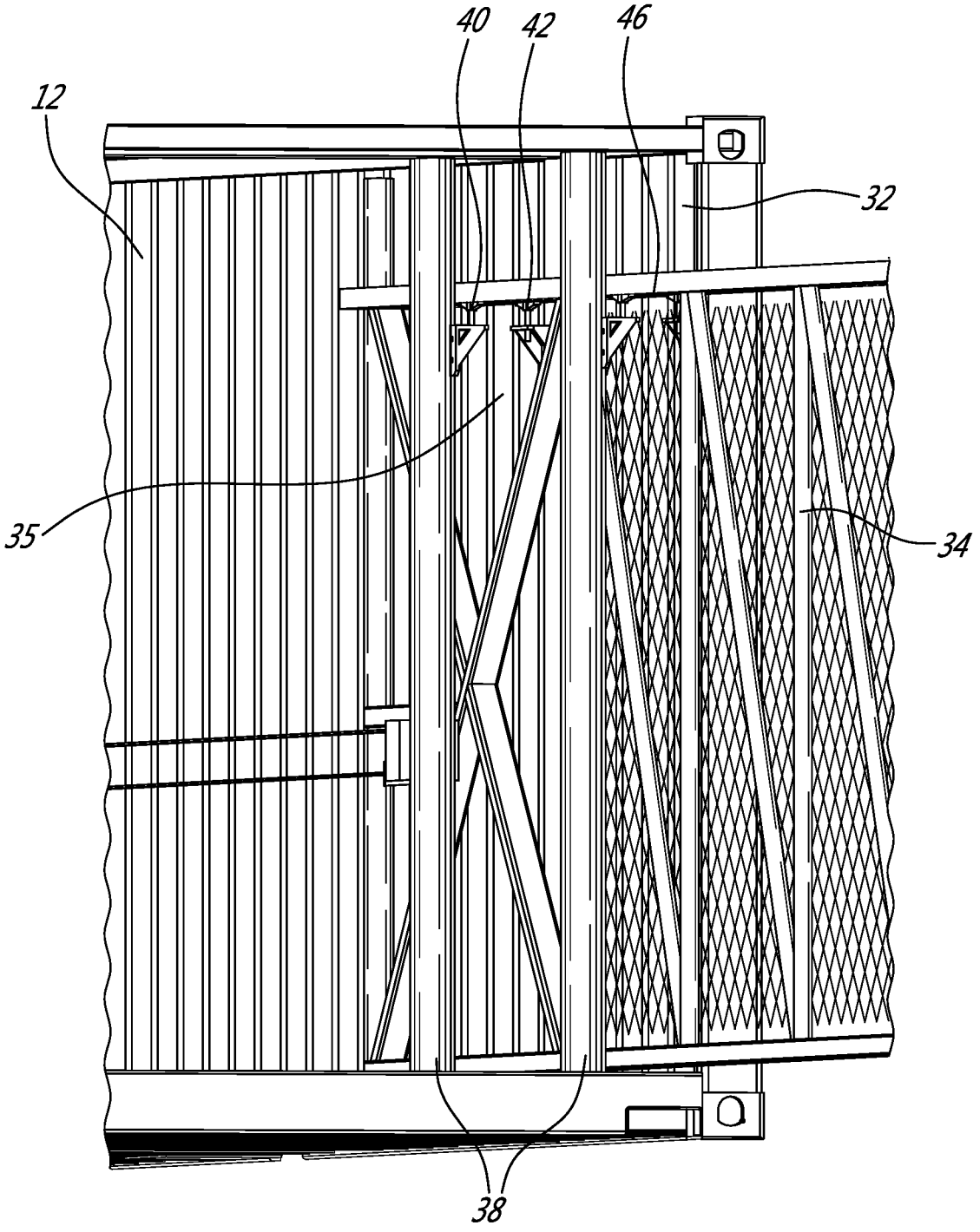
FIG. 3 provides a side lowered perspective view of a modular self-contained gate with the closed end wall hidden, in accordance with an illustrative embodiment of the present invention.
Figure 4:
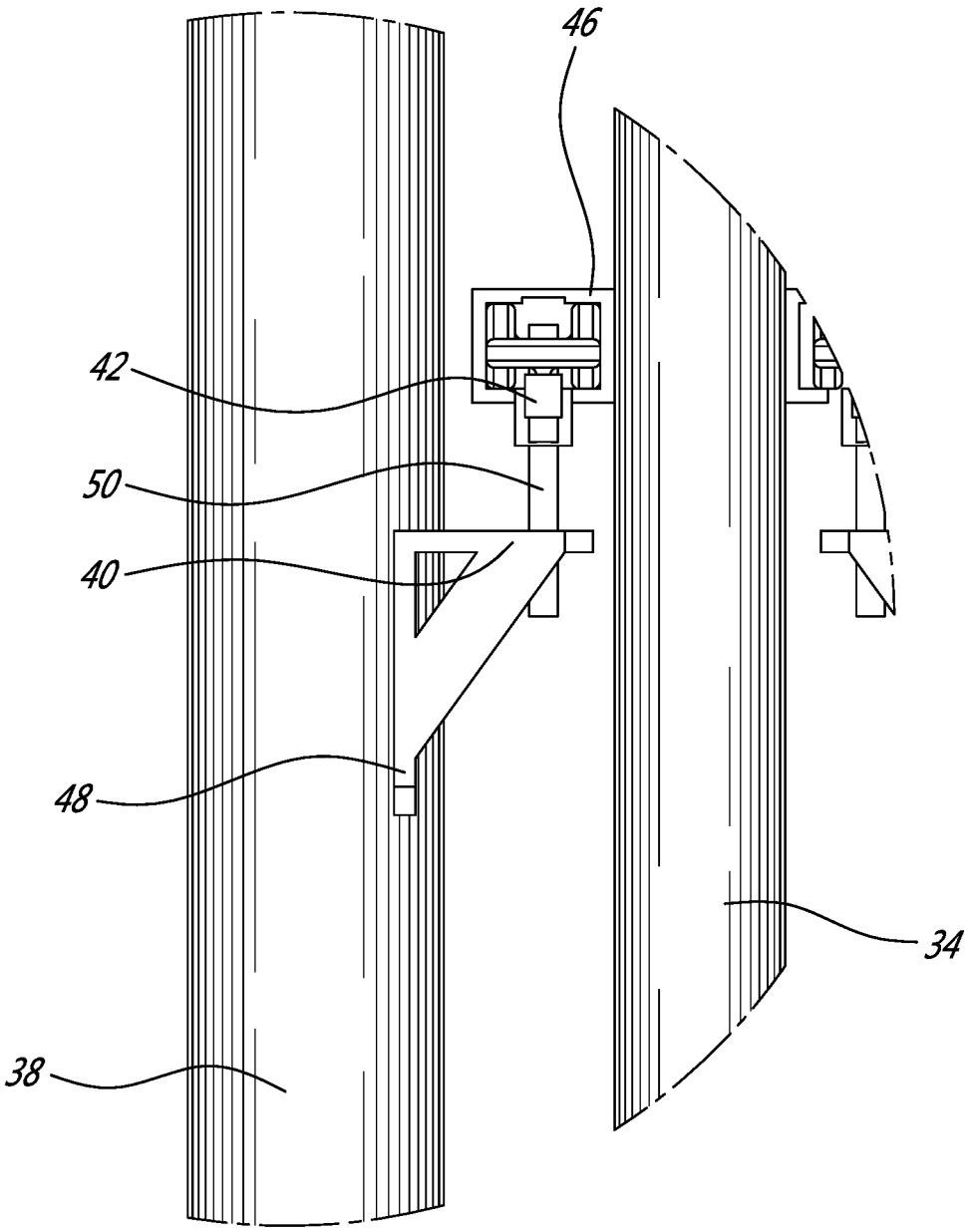
FIG. 4 provides a front schematic view of a gate mounted to a support post for a modular self-contained gate, in accordance with an illustrative embodiment of the present invention.
Figure 5:
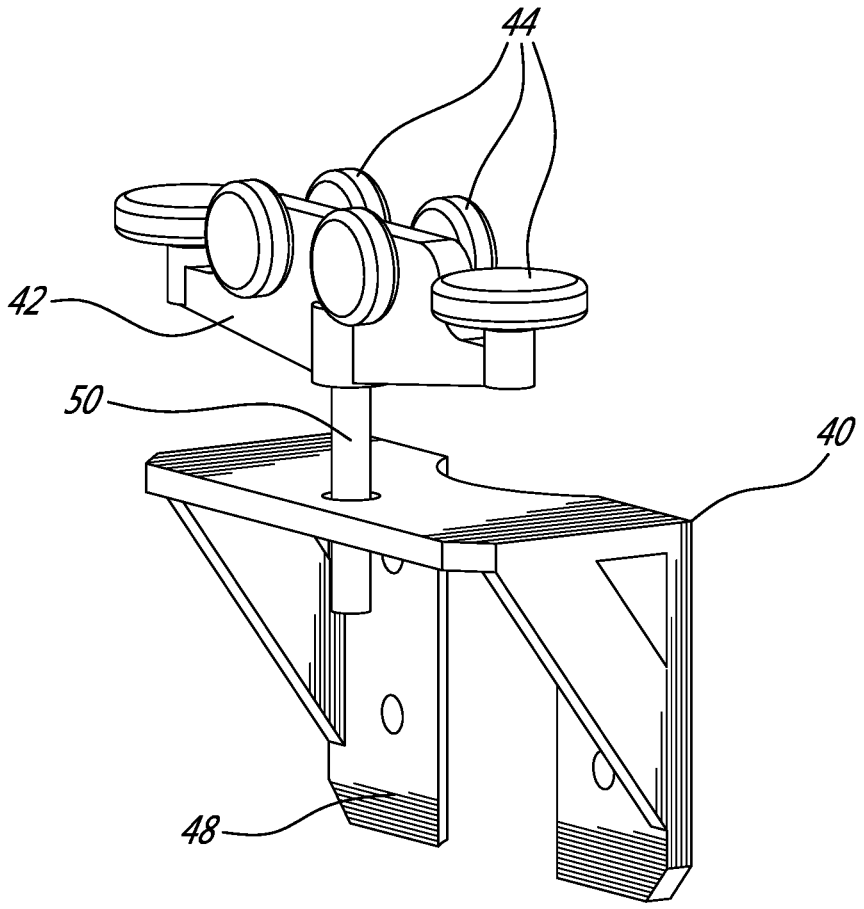
FIG. 5 provides a front raised perspective view of a roller bearing carriage and a support bracket assembly for a modular self-contained gate, in accordance with an illustrative embodiment of the present invention.

Referring now to FIGS. 2 to 4, shipping container 12 comprises an actuator 36 that actuates to linearly displace the gate 34 between the first position A and the second position B, as will be discussed in further detail below, as well as a control panel (not shown) to control the actuator 36. In order to support the gate 34 such that the gate remains suspended above the ground, shipping container 12 comprises a support mechanism 35 comprising a plurality of front support posts 38 adjacent to the opening 32. A support bracket assembly 40 is mounted to each support post 38, each support bracket assembly 40 supporting a roller bearing carriage 42. Referring additionally to FIG. 5, each roller bearing carriage 42 comprises a plurality of roller bearings 44 such that the gate 34 is supported by the plurality of roller bearings 44. Each set of roller bearings 44 are inserted into a stabilizing channel 46 in the gate 34, illustratively a pair of C-channels straddling the top of the gate 34 with a pair of roller bearings 44 contained on each side of the stabilizing channel 46, such that the gate 34 is rollable along the plurality of roller bearings 44 between the first position A and the second position B. The stabilizing channel 46 limits movement of the gate 34 both vertically and laterally, thus only allowing it to displace linearly. For example, each channel 46 may have a width of roughly three inches to maximize the lateral strength acting upon the gate 34, thus limiting the gate's 34 ability to swing laterally when extended. In an embodiment, each roller bearing 44 is mounted with a Teflon guide. In another embodiment, each support bracket assembly 40 comprises a support bracket 48 mounted to a corresponding support post 38 and a threaded rod 50 which links each support bracket 48 to a corresponding roller bearing carriage 42. The heights of the roller bearing carriages 42 are each adjustable via their corresponding threaded rods 50.

Figure 6:
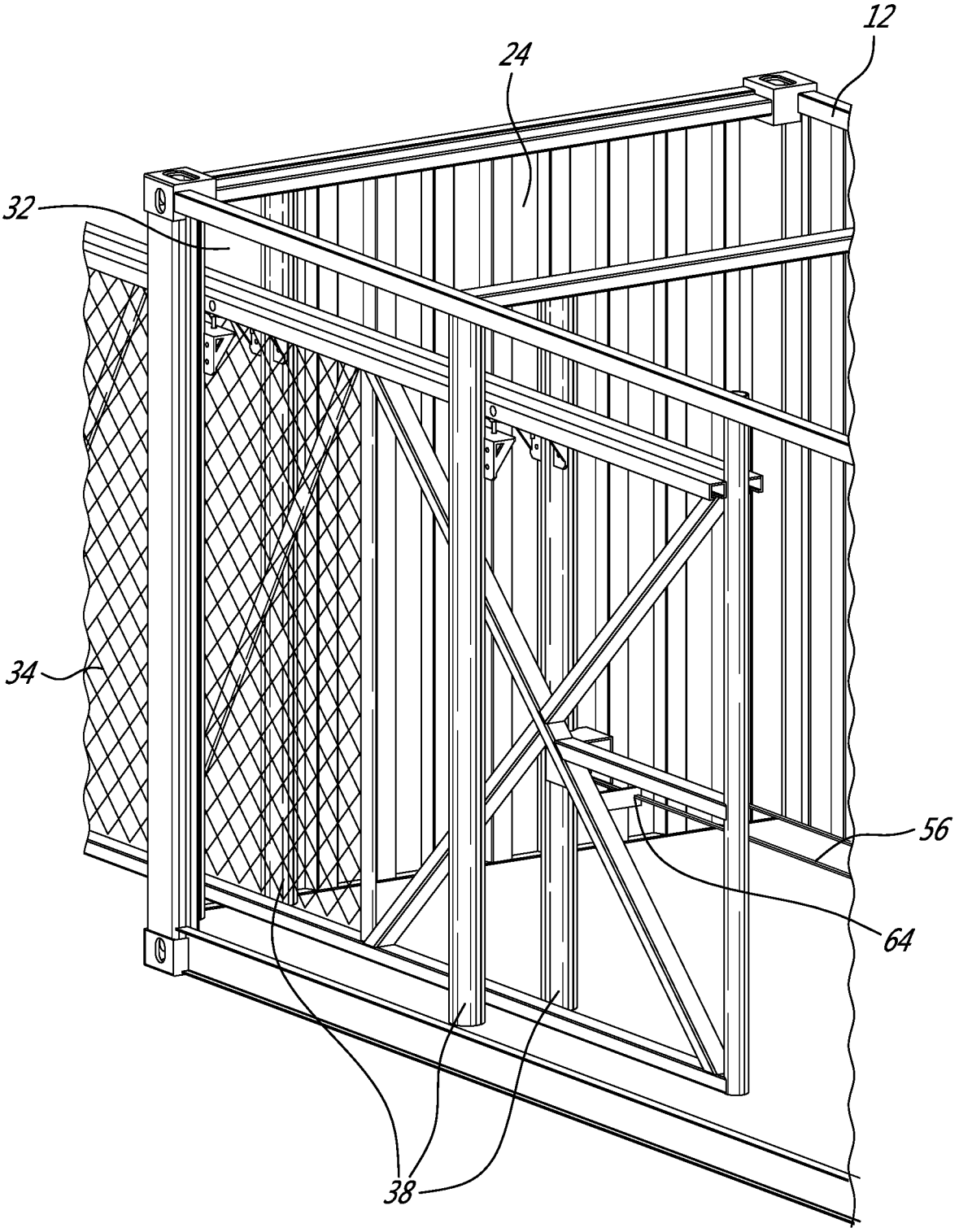
FIG. 6 provides a front raised perspective view of a gate assembly for a modular self-contained gate with the rear wall hidden, in accordance with an illustrative embodiment of the present invention.
Figure 7:
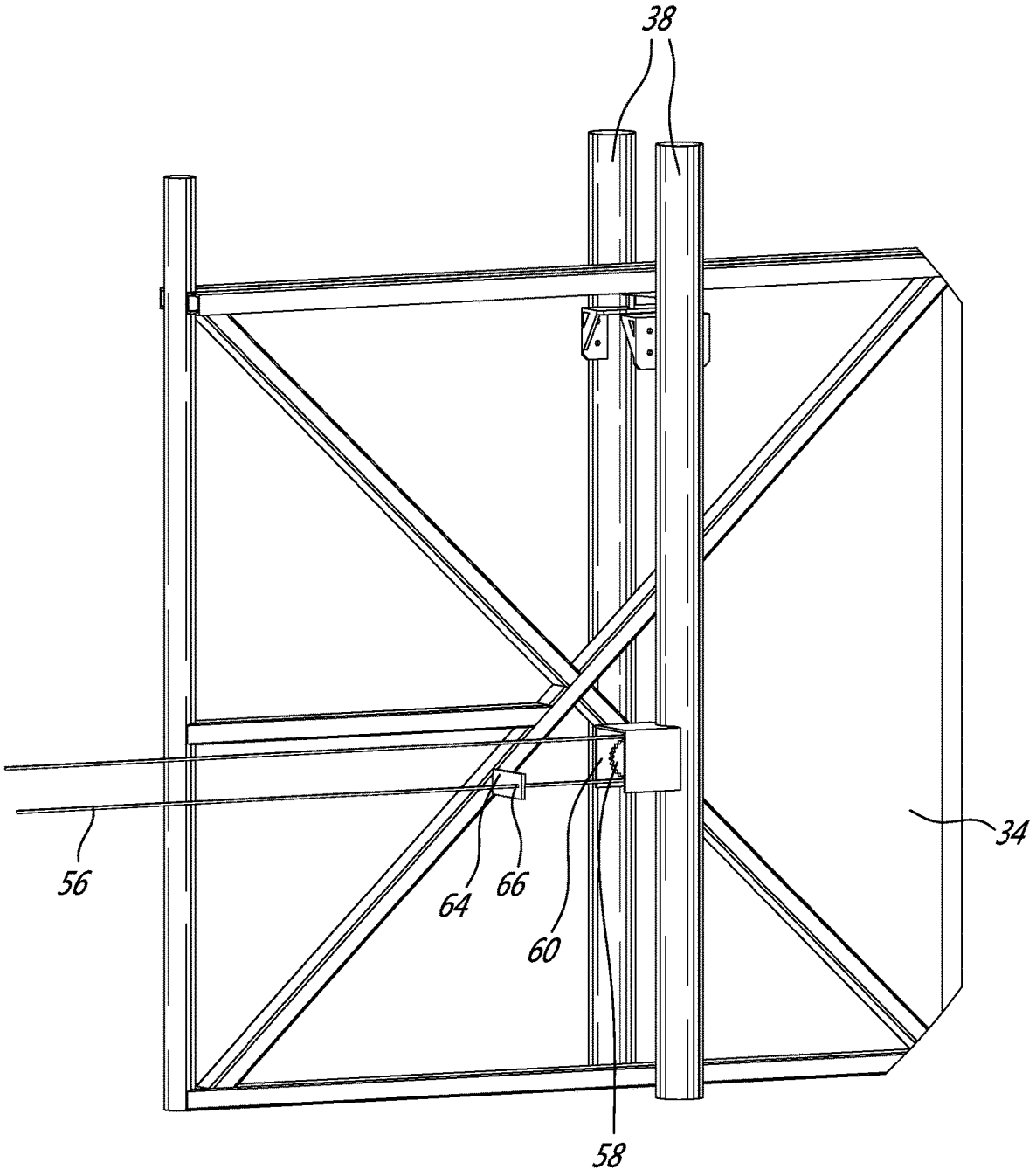
FIG. 7 provides a front raised perspective schematic view of a gate assembly for a modular self-contained gate, in accordance with an illustrative embodiment of the present invention.
Figure 8:
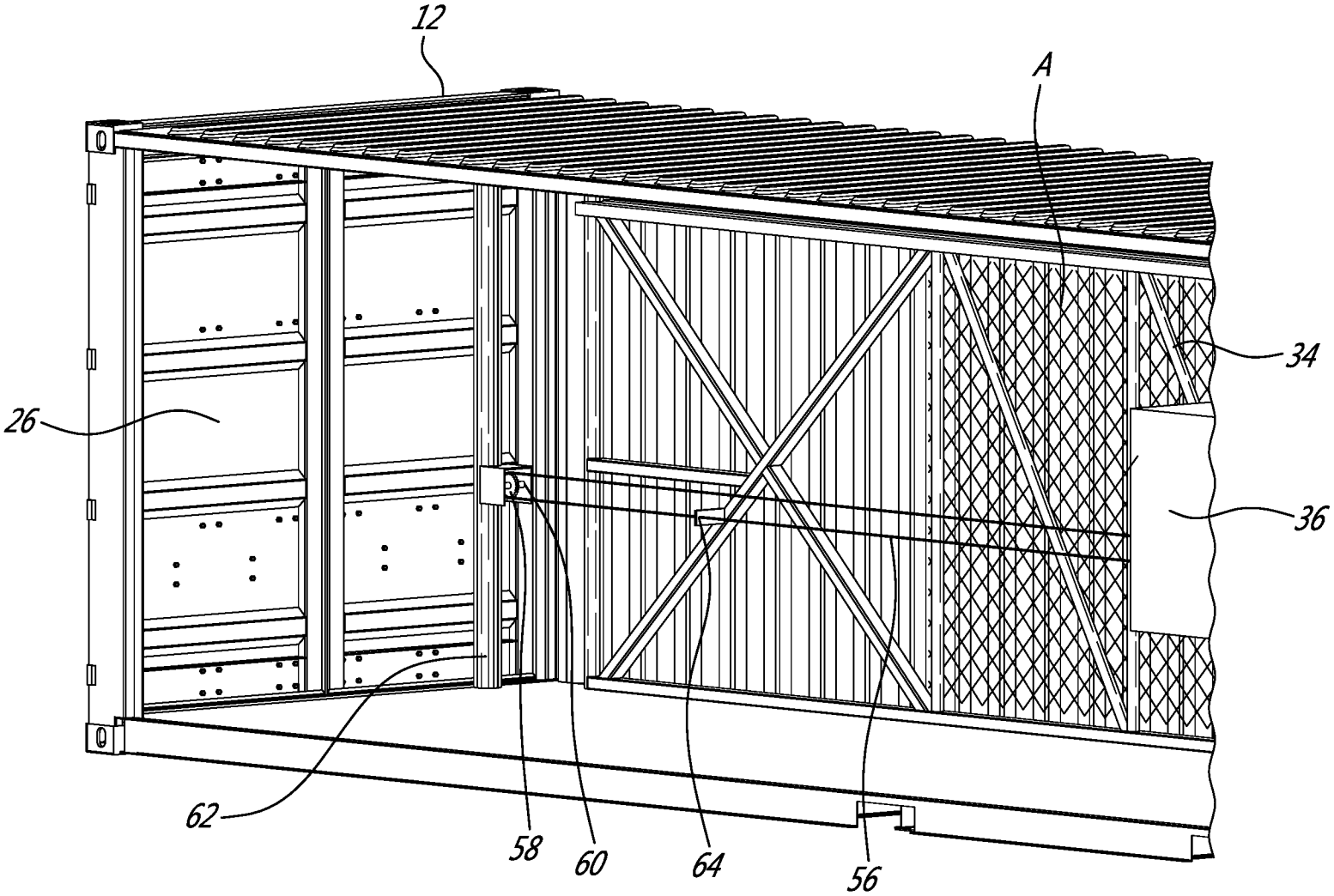
FIG. 8 provides a front raised perspective view of a modular self-contained gate in an open position with the front wall hidden, in accordance with an illustrative embodiment of the present invention.

Referring now to FIGS. 6 to 8 in addition to FIG. 2, the actuator 36 may be powered by a motor 52. In order to open and close the gate 34, the motor 52 is connected to the gate 34 via a motor output drive gear 54 connected to a chain 56, illustratively an 80-50GA industrial chain. In an embodiment, a self-sustaining power generation and storage system (not shown) comprising for example a solar panel and battery system is used to power the actuator 36. The chain 56 runs in a closed loop between two sprockets 58: a first sprocket 58 (as shown in FIG. 6) mounted to one of the plurality of support posts 38 adjacent to the opening 32 in the first closed end wall 24 and a second sprocket 58 (as shown in FIG. 8) mounted to a far-end support post 62 adjacent to the second end wall 26. A pair of sealed roller bearings 60 at each end of the chain 56 link the chain 56 to each sprocket 58. A tab 64 protruding from the gate 34 and comprising a plurality of tensioner bolts 66 connects the gate 34 to the chain 56. As such, when the actuator 36 is activated, the chain 56 either pulls the gate 34 towards the first position A wherein the entryway 14 is open or pushes the gate 34 towards the second position B wherein the entryway 14 is closed. In the first position A, the gate 34, along with the other above-mentioned components of the modular self-contained gate 10, are stored inside the container 12 and are thus protected from the elements. Further, since the components required to open the gate 34 are stored inside the container 12 which is lockable via lockable entrance 30, thieves would experience much difficulty in attempting to open gate 34 and access entryway 14.

Referring back to FIG. 2, when the gate 34 is in its second position B, a substantial portion of the gate 34, illustratively four fifths of the gate 34, is outside of the shipping container 12. A portion of the gate 34, illustratively one fifth of the gate, remains inside shipping container 12, thus providing the gate 34 with sufficiently stability to ensuring that the gate 34 remains suspended over the ground, even at its distal end in the second position B. Referring additionally to FIG. 6, the placement of the various support posts 38 ensure that the gate 34 can span as wide an entryway 14 as possible while retaining sufficient strength. As such, a first pair of support posts 38 may be positioned as close to the opening 32 as possible while ensuring that the roller bearing carriages 42 remain inside the shipping container 12. Such positioning maximizes the cantilever effect of the gate 34. Further, a second pair of support posts 38 may be positioned, for example, roughly five feet away from the first pair of support posts 38. Such positioning maximizes the extendable distance of the gate 34 while ensuring a sufficient length of gate 34 remains inside the container 12 to support the cantilevered end.

In an alternate embodiment, the layout inside the shipping container 12 is mirrored at its far end such that the gate 34 may exit the container 12 through a second opening 32 in the second end wall 26. In this embodiment, rather than comprising only a single far-end support post 62, the container 12 comprises a plurality of far-end support posts 62, each comprising a roller bearing carriage 42 and corresponding components to allow the gate 34 to additionally exit the container 12 through the second opening 32 in the second end wall 26 to open and close a second entryway 14. In an additional alternate embodiment, a second gate 34 exitable through the second opening 32 in the second end wall 26 may be provided, along with corresponding components, such that the modular self-contained gate 10 may individually and simultaneously secure an entryway 14 on either side of shipping container 12.

In various embodiments, the gate 34 is openable and closable through the use of a keypad system (not shown) linked to the actuator 36. A radio-controlled remote (not shown) may also be provided to open and close the gate 34. In case of a power outage, a manual disconnect lever (not shown) may be provided to allow for manual operation of the gate 34. In an alternate embodiment, the modular self-contained gate 10 does not comprise an actuator 36, and gate 34 is openable and closable by manual means only. In another embodiment, a surveillance system (not shown) may be provided to remotely monitor the system 10. The surveillance system may comprise, for example, a security camera and an autonomous drone. A guard house (not shown) comprising a windowed security office may also be provided to increase the security of the modular self-contained gate 10.

Figure 9:
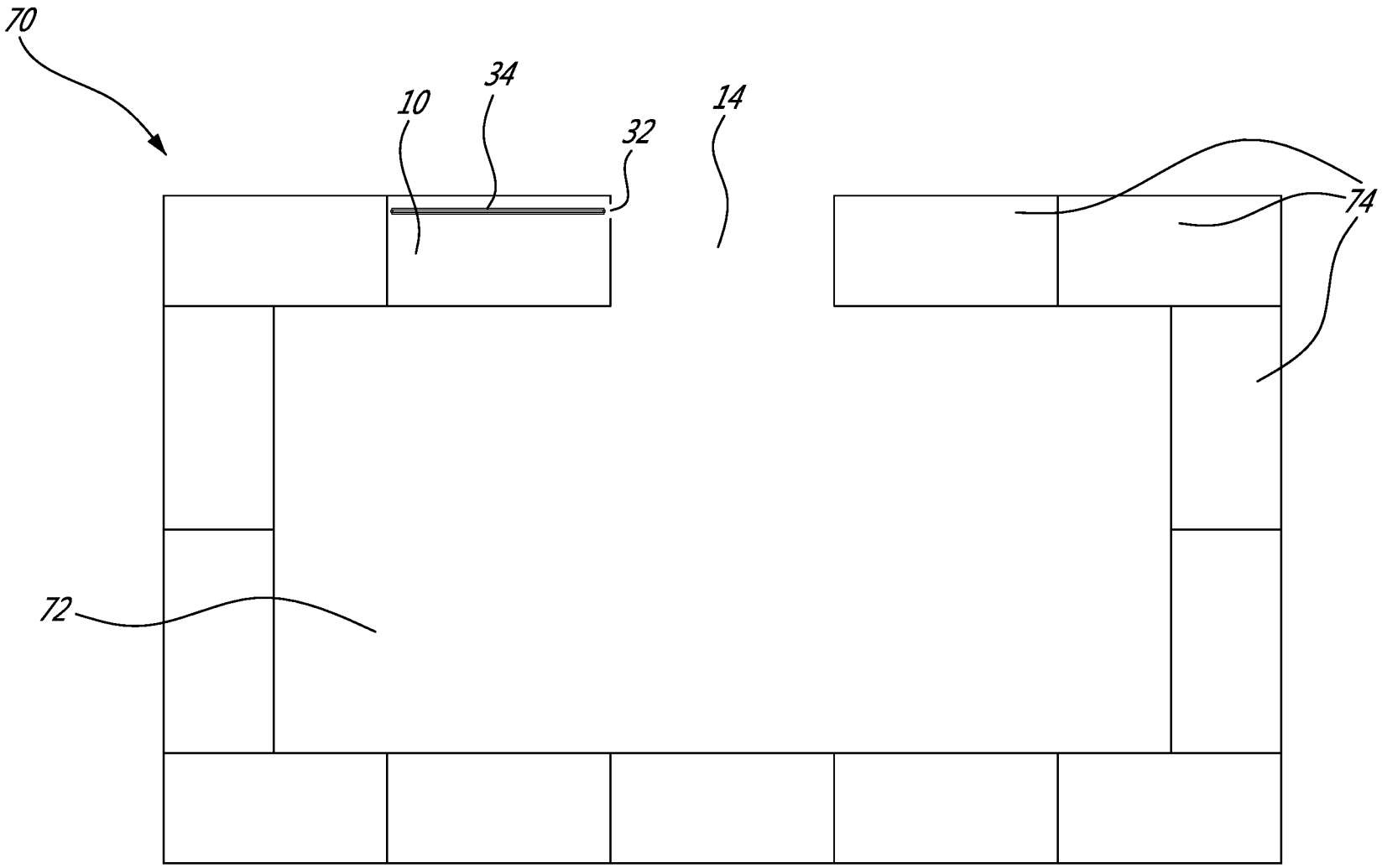
FIG. 9 provides a top schematic view of a system for selectively allowing and blocking access to an area, in accordance with an illustrative embodiment of the present invention.

Referring now to FIG. 9, there is shown a system 70 for selectively allowing and blocking access to an area 72, for example a shipping yard. A plurality of abutting ISO standard shipping containers 74 and a modular self-contained gate 10 (as described above) abutting with one of the ISO standard shipping containers 74 define the area 72, for example in a rectangle-like formation. An entryway 14 defined by a gap between the modular self-contained gate 10 and one of the ISO standard shipping containers 74 provides access to the area 72. The length of the entryway 14 is at most the same as the length of the gate 34. As such, the gate 34 may allow or block access to the area 72 by linearly displacing outside of the modified shipping container 12 to close at least a portion of the entryway 14.

Although the present invention has been described hereinabove by way of specific embodiments thereof, it can be modified, without departing from the spirit and nature of the subject invention as defined in the appended claims.

The invention claimed is:

1. A modular self-contained gate for selectively blocking an entryway comprising:

an ISO standard shipping container modified such that an existing closed end wall of said shipping container comprises an elongate slot-like opening arranged vertically and adjacent an edge of said closed end wall;

a substantially flat and rectangular gate comprising a long edge having a length substantially the same as a length of said shipping container and a height less than a height of said opening, said gate aligned with and linearly displaceable along a path of travel through said opening between a first position wherein said gate is stored inside said shipping container and the entryway is open and a second position wherein said gate is extended outside of said shipping container and passage via the entryway is barred; and a gate support assembly inside said shipping container comprising two pairs of vertical support posts, each pair of said posts arranged adjacent one another and defining a vertical gate receiving gap therebetween, a first of said pairs of support posts positioned immediately adjacent said opening, a second of said pairs of support posts positioned displaced from said first of said pairs of support posts along said path of travel and such that said gate travels between each pair of said pairs of posts, each of said pairs of posts further comprising a pair of bracket assemblies, one of said bracket assemblies on each post and arranged opposite one of another, rollers of a first of said bracket assemblies running in a first of a pair of parallel tracks running along a top of said gate and rollers of a second of said bracket assemblies running in a second of said parallel tracks and such that said gate is suspended above the ground.

2. The modular self-contained gate of claim 1, further comprising an actuator for moving said gate between said first position and said second position.

3. The modular self-contained gate of claim 2, further comprising a control panel for controlling said actuator.

4. The modular self-contained gate of claim 2, wherein said actuator comprises a motor and a chain, said chain connecting said motor to said gate via a motor output drive gear, and the modular self-contained gate further comprises a first sprocket connecting said chain to a far-end support post adjacent to a second said closed end wall via a first pair of sealed roller bearings, a second sprocket connecting said chain to one of said front support posts via a second pair of sealed roller bearings, and a tab emanating from said gate attaching said chain to said gate via a plurality of tensioner bolts.

5. The modular self-contained gate of claim 2, further comprising a self-sustaining power generation and storage system to power said actuator.

6. The modular self-contained gate of claim 2, wherein said gate is openable and closable by at least one of a keypad system, a radio-controlled remote, and a manual disconnect lever.

7. The modular self-contained gate of claim 1, wherein said shipping container further comprises a lockable entrance.

8. The modular self-contained gate of claim 7, wherein said lockable entrance comprises a door.

9. The modular self-contained gate of claim 1, wherein the modular self-contained gate is transportable.

10. The modular self-contained gate of claim 1, wherein each of said rollers comprises a roller bearing is mounted with a Teflon guide.

11. The modular self-contained gate of claim 1, further comprising a surveillance system for monitoring the modular self-contained gate.

12. The modular self-contained gate of claim 11, wherein said surveillance system comprises at least one of a security camera and an autonomous drone.

13. The modular self-contained gate of claim 1, wherein said gate is supported at one end such that a suspended end of said gate resists dipping when in said second position.

14. The modular self-contained gate of claim 1, wherein each of said pair of bracket assemblies comprises a support bracket mounted to a respective support post and a threaded rod linking a roller bearing carriage to said support bracket, wherein the height of each of said roller bearing carriages is adjustable via a corresponding said threaded rod.

15. The modular self-contained gate of claim 1, further comprising a plurality of far-end support posts and a second said opening in a second end wall such that a second entryway is securable by said system.

16. The modular self-contained gate of claim 15, further comprising a second said gate exitable through said second opening in said second end wall such that said first entryway and said second entryway are individually and simultaneously securable by said system.

* * * * *